United States Patent [19]

Fals

[11] 4,064,781

[45] Dec. 27, 1977

[54] GUITAR PICK

[75] Inventor: Henry J. Fals, Vacaville, Calif.

[73] Assignee: The Raymond Lee Organization, Inc., New York, N.Y. ; a part interest

[21] Appl. No.: 740,593

[22] Filed: Nov. 10, 1976

[51] Int. Cl.[2] ..... G10D 3/16; G10D 5/00

[52] U.S. Cl. ..... 84/322; 84/1.15

[58] Field of Search ..... 84/1.15, 1.16, 320, 84/321, 322

[56] References Cited

U.S. PATENT DOCUMENTS

| | | | |
|---|---|---|---|
| 2,528,663 | 11/1950 | Mitchell | 84/320 X |
| 3,290,425 | 12/1966 | Stobaugh | 84/1.16 |
| 3,530,227 | 9/1970 | Wheeler et al. | 84/1.16 |

*Primary Examiner*—Lawrence R. Franklin
*Attorney, Agent, or Firm*—Daniel Jay Tick

[57] ABSTRACT

A generally triangular base of electrically insulative material has a base edge and a vertex area opposite the base edge. A guitar pick is mounted in the base at the vertex edge thereof and extends therefrom to form a triangular configuration. A sheet of electrically conductive material is embedded in the base in spaced parallel proximity with the base edge. A microphone is embedded in the base and extends between the pick and the sheet of electrically conductive material and in close proximity with each. Electrically conductive material is electrically connected to the microphone and to the sheet in the base and extends out of the base for connection to an amplifier.

3 Claims, 3 Drawing Figures

GUITAR PICK

BACKGROUND OF THE INVENTION

The present invention relates to a guitar pick. More particularly, the invention relates to a guitar pick for steel string guitars.

Objects of the invention are to provide a guitar pick of simple structure which functions efficiently, effectively and reliably to faithfully pick up each sound produced on a steel string guitar.

BRIEF DESCRIPTION OF THE DRAWINGS:

In order that the invention may be readily carried into effect, it will now be described with reference to the accompanying drawings, wherein.

DETAILED DESCRIPTION OF THE INVENTION

The guitar pick of the invention is for steel string guitars (not shown in the FIGS).

Figure 1:
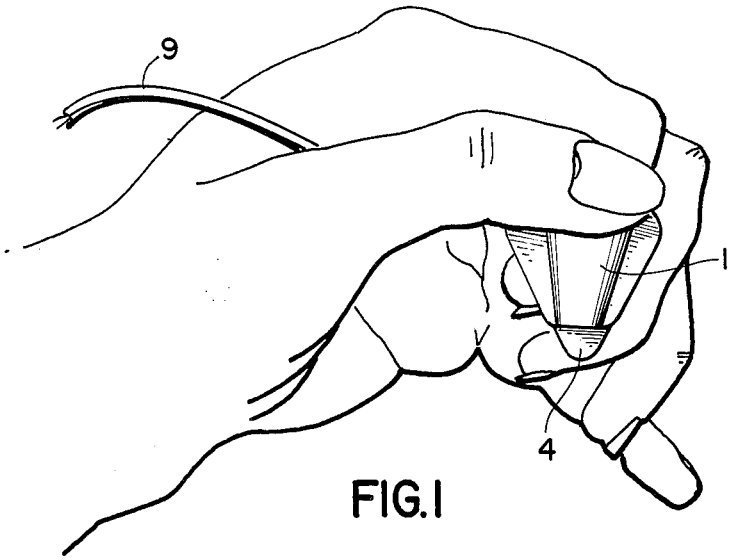
FIG. 1 is a view of an embodiment of the guitar pick of the invention as it is held for use.
Figure 2:
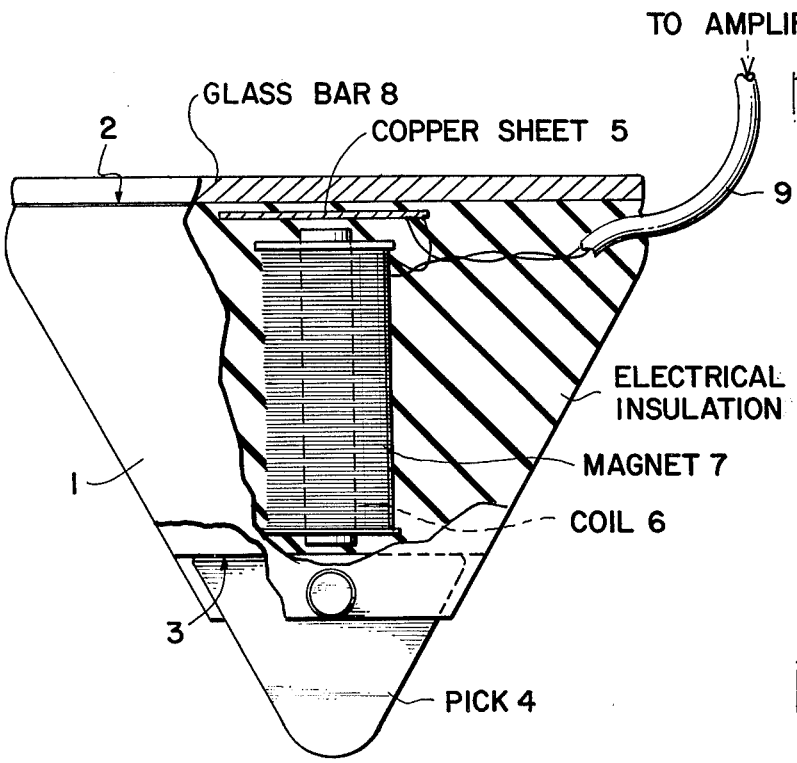
FIG. 2 is a partly cutaway, partly cross-sectional view, on an enlarged scale, of an embodiment of the guitar pick of the invention.
Figure 3:
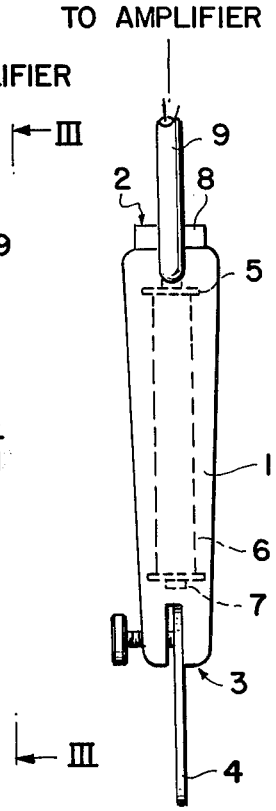
FIG. 3 is a view, taken along the lines III—III, of FIG. 2.

The guitar pick of the invention comprises a generally triangular base 1 of electrically insulative material such as, for example, rubber, having a base edge 2 and a vertex area 3 opposite said base edge (FIGS. 2 and 3).

The guitar pick 4 is mounted in the base 1 at the vertex area 3 thereof and extends from said vertex area to form a substantially triangular configuration, as shown in FIG. 2.

A sheet 5 of electrically conductive material, such as, for example, copper, is embedded in the base 1 in spaced parallel proximity with the base edge 2 thereof, as shown in FIGS. 2 and 3.

A microphone device is embedded in the base 1 and extends between the pick 4 and the sheet 5 of electrically conductive material and in close proximity with each. The microphone device comprises a coil 6 of electrically conductive wire and a magnet 7 coaxially positioned in said coil (FIGS. 2 and 3).

A glass bar 8 (FIGS. 2 and 3) is provided in the base 1 and extends along the base edge 2 thereof.

Electric conductors 9 are electrically connected to the microphone device 6, 7 and the sheet 5 in the base 1, as shown in FIG. 2, and extend out of said base for connection to an amplifier.

While the invention has been described by means of a specific example and in a specific embodiment, I do not wish to be limited thereto, for obvious modifications will occur to those skilled in the art without departing from the spirit and scope of the invention.

I claim:

1. A guitar pick for steel string guitars, said guitar pick comprising
   - a generally triangular base of electrically insulative material having a base edge and a vertex area opposite the base edge;
   - a guitar pick mounted in the base at the vertex area thereof and extending therefrom to form a substantially triangular configuration;
   - a sheet of electrically conductive material embedded in the base in spaced parallel proximity with the base edge thereof;
   - microphone means embedded in the base and extending between the pick and the sheet of electrically conductive material and in close proximity with each; and
   - electrically conductive means electrically connected to the microphone means and the sheet in the base and extending out of the base for connection to an amplifier.

2. A guitar pick as claimed in claim 1, wherein the microphone means comprises a coil of electrically conductive wire and a magnet coaxially positioned in the coil.

3. A guitar pick as claimed in claim 1, further comprising a glass bar in the base and extending along the base edge thereof.

* * * * *